United States Patent [19]

Nickels, Jr. et al.

[11] Patent Number: 4,590,853

[45] Date of Patent: May 27, 1986

[54] MODULAR PRINT HEAD

[75] Inventors: Richard C. Nickels, Jr., Hampstead; Richard L. Allgaier, Jr., Reisterstown, both of Md.

[73] Assignee: General Instrument Corporation, New York, N.Y.

[21] Appl. No.: 602,817

[22] Filed: Apr. 23, 1984

[51] Int. Cl.[4] ..... B41J 3/10

[52] U.S. Cl. ..... 101/93.48; 101/93.04; 101/93.05; 400/124

[58] Field of Search ..... 400/121, 124; 101/93.04, 93.05, 93.48

[56] References Cited

U.S. PATENT DOCUMENTS

| | | | |
|---|---|---|---|
| 3,983,806 | 10/1976 | Ishi | 101/93.48 |
| 4,114,532 | 9/1978 | Arzoumanian | 101/93.48 |
| 4,211,493 | 7/1980 | Costello et al. | 400/121 |
| 4,260,269 | 4/1981 | Peroutky | 400/121 |
| 4,349,283 | 9/1982 | Sapitowicz et al. | 400/124 |

FOREIGN PATENT DOCUMENTS

| | | | |
|---|---|---|---|
| 56-86773 | 7/1981 | Japan | 400/124 |
| 56-86774 | 7/1981 | Japan | 400/124 |
| 2035219 | 6/1980 | United Kingdom | 400/124 |

*Primary Examiner*—Edgar S. Burr
*Assistant Examiner*—David A. Wiecking
*Attorney, Agent, or Firm*—James & Franklin

[57] ABSTRACT

A print head for use in a dot matrix printer or the like which comprises a plurality of non-magnetic frames which carry aligned magnets, the frames being arranged in a stack with spaces formed by projecting parts on the frames between the magnets carried thereby, the printer hammers being movably located in those spaces and extending out between the frames to the printing station. A head comprising a desired number of hammers is built up by stacking the appropriate numbers of alternating frames and hammers.

6 Claims, 3 Drawing Figures

MODULAR PRINT HEAD

BACKGROUND OF THE INVENTION

The present invention relates to the construction of a print head for use in a dot matrix printer or the like which is modular in nature, permitting variable length printers to be assembled by stacking standard components to a desired degree.

A dot matrix printer is an apparatus which prints a plurality of closely spaced dots at high speed at selected locations on a paper strip to form letters, numerals or other intelligible symbols thereon. The dots are formed by causing contact between the paper and an ink impregnated surface at the desired locations by selectively electromagnetically displacing elongated print wires mounted within the print head.

Certain types of known dot matrix print heads consist of plurality of selectively electrically energizable solenoids, each of which has a separate print wire extending therefrom. The impact ends of the print wires are retained in a fixed position with respect to each other by a stationary wire bearing which forms a part of the head. The wire bearing has a plurality of closely spaced openings, arranged in a matrix array. Each opening receives the impact end of a different print wire. Energization of a selected solenoid results in the print wire associated therewith being displaced, such that the impact end thereof extends beyond the surface of the bearing and causes contact between the paper and the ink impregnated surface. The paper is moved relative to the wire bearing in a first direction, such that printing of symbols can take place along a line and in a second direction such that different lines can be printed.

The type of hammer comprising a solenoid and print wire, as shown in U.S. Pat. No. 4,349,283 of Sept. 14, 1982, entitled "Hammer for Dot Matrix Printer", assigned to the assignee of this application, may be considered exemplary of the type of hammer means suitable for use in connection with the present invention, but the present invention is not limited thereto. In addition, in copending application Ser. No. 485,749 of Apr. 18, 1983, abandoned and refiled as Ser. No. 690,416, which issued as U.S. Pat. No. 4,534,287 on Aug. 13, 1985, entitled "Improved Dot Matrix Print Head" and applied for in the name of Robert A. Meloni, also assigned to the assignee of this application, a particular type of head is disclosed in which the ends of the print wires are secured within a low inertia member which, when moved, positions the impact ends of the print wires, and the device of the present invention will be here specifically disclosed in connection with such an improved print head, but here again the present invention is not limited to use with a print head of that type.

Hammers of the type particularly applicable to the present invention are extremely thin, coil carrying hammers.

One problem which has arisen in making heads including hammers of the type described arises from the fact that a plurality of those hammers are interpositioned between a single pair of stationary magnets, the spacing between the magnets being dependent upon the number of hammers interpositioned therebetween and that spacing thus increasing as the number of hammers is increased. As the magnet spacing increases, the strength of the magnetic field active on the hammers, and particularly the hammers at the middle of the stack, decreases. This in turn increases the requirement for the minimum signal strength to be applied to each individual hammer solenoid, and also tends to lessen the speed with which the hammer responds when a signal is applied thereto. This places a limitation on the number of hammers that can effectively be interpositioned between a given pair of magnets.

Moreover, each time that a unit is designed with a different number of hammers, the entire print head structure must be redesigned in order to accommodate the new hammer and spacing requirements. Tooling and design costs become significant.

It is a prime object of the present invention to provide a dot matrix print head of modular construction, one which may be built up to utilize any desired number of hammers through the use of standard components and without requiring redesign or modification of the parts thereof.

It is a further object of the present invention to provide a print head construction which can be easily modified to provide different print formats, by increasing or decreasing the number of characters or to increase or decrease print speed by changing the number of characters printed, without requiring redesign of the head parts.

It is yet another object of the present invention to provide a print head formed of a plurality of sturdy structural elements which may be easily and inexpensively manufactured, and to no excessive degree of precision.

It is a further object of the present invention to provide a dot matrix print head formed of structural frame elements stackable one upon the other to any desired degree, those elements being so constructed that when they are stacked, spaces are provided between them within which solenoid-type hammers may be received and from which operative portions of those hammers may freely movably extend, the elements themselves carrying the magnets which cooperate with the solenoids.

To these ends the print head is formed of a plurality of sturdy non-magnetic frame pieces each carrying magnets which, when the frame pieces are stacked one on the other, cooperate with one another to define the magnetic field within which the solenoid-type hammers function. The stack of hammers is so constructed that there are spaces formed between the magnets of adjacent frames, within which spaces flat solenoid-type hammers are freely movable received, and the periphery of the frames, when stacked, define openings through which electrical access to the solenoids may be achieved and through which the print wires and/or their supporting structure may freely movably extend to points outside the head where the impact ends of the print wires may perform their printing function. Any desired number of frames and magnets can be formed into a stack, depending upon the number of hammers desired in a given piese of apparatus. Because the frames carry magnets, the magnetic field active on each solenoid is quite strong even though a very large number of hammers may be employed in a given place of apparatus, and hence optimum hammer speed and optimum minimal signal magnitude are achieved. Because the head is built up to desired length from a plurality of similar items, with the same items being used whether the number of hammers is great or small, significant manufacturing economies are achieved.

To these and such other objects as may hereinafter appear, the present invention relates to a modular construction of a dot matrix print head or the like, as described in the following specification and set forth in the annexed claims, taken together with the accompanying drawings, in which:

Figure 1:
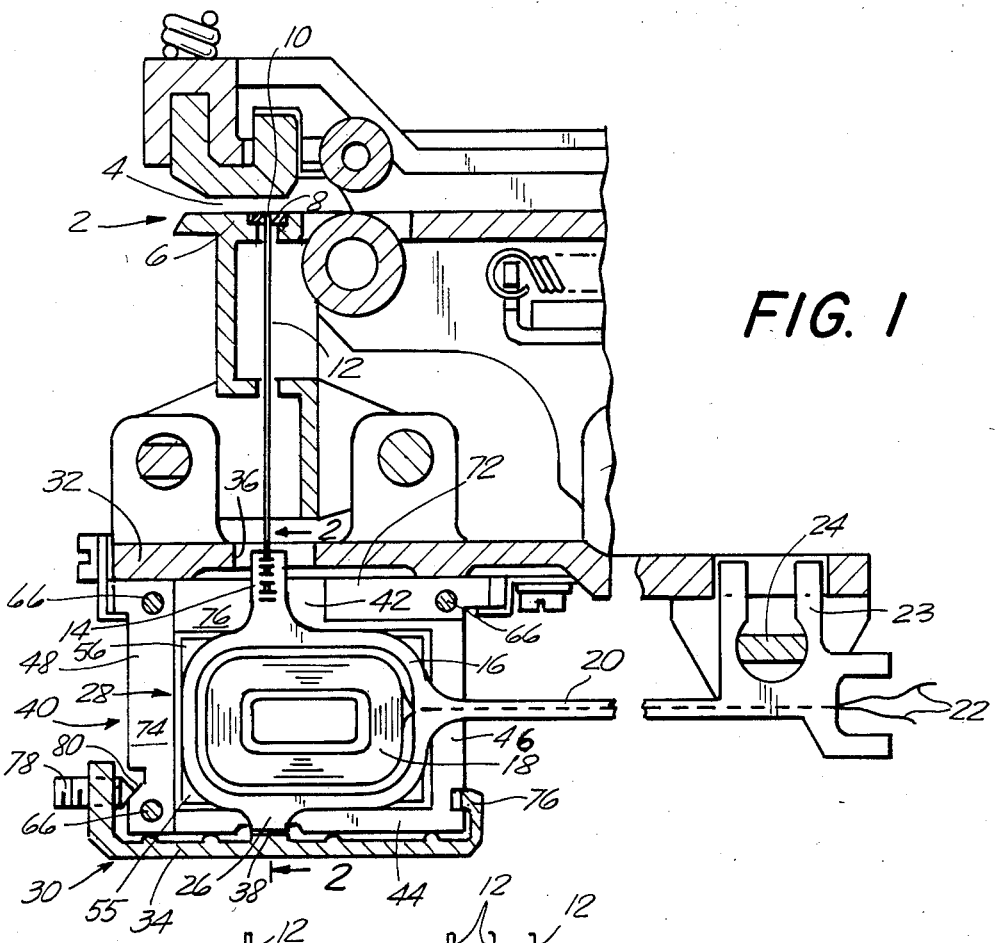
FIG. 1 is a cross-sectional view of the printing portion of an exemplary dot matrix printer, with the print head of the present invention being incorporated therein, the cross-section being taken between two adjacent frame pieces of the stack of such frame pieces which makes up the print head.

As shown in FIG. 1, the printer comprises a support generally designated 2 defining a space 4 through which paper to be printed is adapted to pass, that support comprising a lower support part 6 within which a shuttle 8 is mounted to be movable in a direction into and out of the plane of FIG. 1. The shuttle 8 is provided with openings 10 within which the impact ends of print wires 12 are received, those wires extending from protruding parts 14 of flat frame-like portions 16 within which a flat multi-turn solenoid coil 18 is received. Extending laterally from the frame-like portion 16 is an elongated portion 20 within which lead wires 22 extending to the solenoid 18 are received, the part 20 at its end carrying bifurcated part 23 within which supporting element 24 is adapted to be snugly received. The frame-like part 16, on its side opposite the protruding part 14, has a second and short protruding part 26. The elements 12–26 define a hammer, generally designated 28.

The print head for supporting and operatively mounting the hammers 28 is generally designated 30. It comprises upper and lower support pieces 32 and 34 suitably fixed to the instrument frame to define the upper and lower limitation of the print head, the upper support piece 32 having an opening 36 through which the print wires 12 and protruding parts 14 of the various hammers 28 freely pass and the lower support piece 34 carrying a pad 38 against which the downwardly protruding part 26 of the hammers 28 is adapted to engage when the hammer is at rest.

Figure 3:
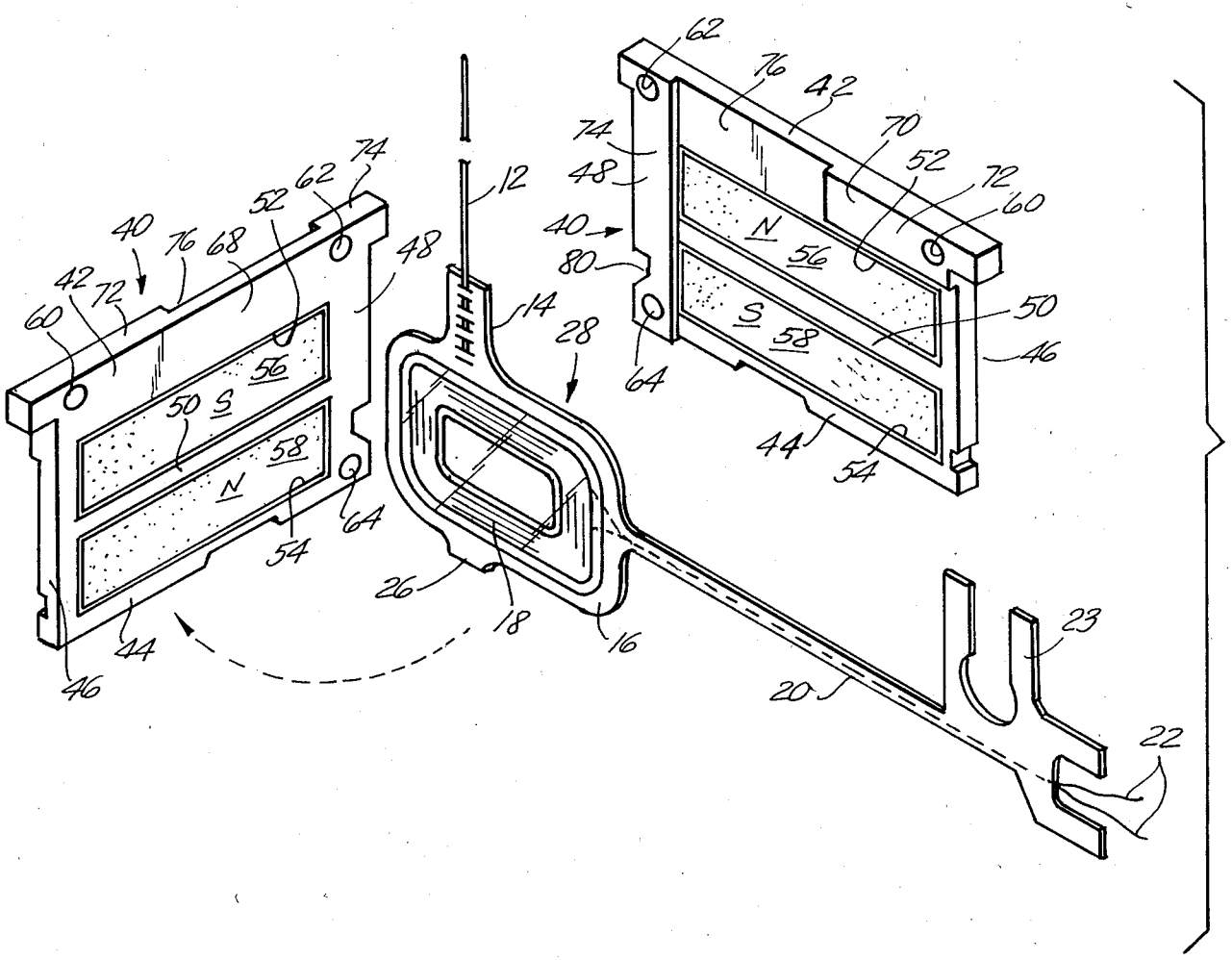
FIG. 3 is a three quarter perspective exploded view of two frame pieces and a solenoid type hammer such as is disclosed in FIGS. 1 and 2.

The print head is built up of a plurality of non-magnetic frame pieces generally designated 40, each formed of some suitable non-magnetic material such as sintered aluminum or glass-reinforced plastic. Each frame comprises a top bar 42, a bottom bar 44, and side bars 46 and 48. The space between the top bar 42 and the bottom bar 44 is divided by an intermediate bar 50, thus producing elongated spaces or apertures 52 and 54 in the frame piece 40. Received within the spaces 52 and 54, and there secured in any appropriate manner, as through the use of cement, are magnets 56 and 58, with magnetic polarity as indicated by the letters N and S in FIG. 3. Preferably the thickness of the magnets 56 and 58 is no greater than the depth of the spaces 52 and 54 in which they are received, but that is not an essential feature.

At three of the corners of the frame piece 40 mounting holes 60, 62 and 64 are provided, adapted to receive mounting rods 66 (see FIG. 1).

The front face 68 of the frame piece 40 is flat. The rear face 70 has portions 72 and 74 which are thicker than the other portions of the frame piece, with a recess 76 being formed in the face 70 between the portions 72 and 74. The extra thickness of the portions 72 and 74 over and above the thickness of the remainder of the frame piece is somewhat greater than the thickness of the solenoid-type hammer 28.

Figure 2:
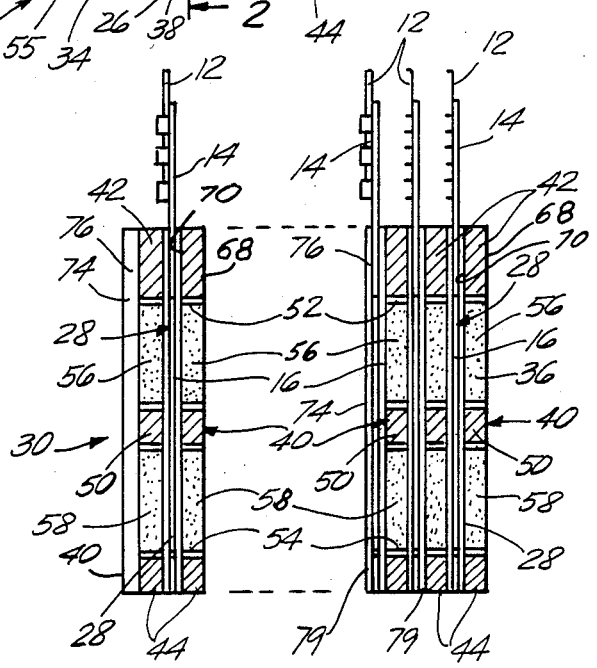
FIG. 2 is a cross-sectional view of the print head stack taken along the line 2—2 of FIG. 1.

To assemble the print head a desired number of the frame pieces 40 are stacked on the assembly rods 66, with the front surface 68 of each frame piece 40 engaging the portions 72 and 74 of the rear face 70 of the next adjacent frame piece 40. Individual hammers 28 are lodged between the frame pieces 40 in the spaces produced by the thickened portions 72 and 74, the protruding portion 14 of the hammer carrying the print wire 12 extending freely out through the space 76 and the portion 20 of the hammer with the solenoid lead wires 22 extending out freely between the right-hand end bars 46 of adjacent frame pieces 40. Thus, as can best be seen from FIG. 2, each solenoid 18 is located closely between adjacent pairs of magnets 56, 58, the magnets themselves being relatively close to one another, so that the magnetic field traversed by the solenoid 18 is quite strong.

The hammers 28 normally assume the position shown in FIG. 1, with the downwardly protruding hammer portion 26 resting on the pad 38, but when an appropriate electrical signal is applied to a given solenoid 18 via its lead wires 22, the magnetic field produced by the current in the solenoid 18 will cause the hammer to rise, the elongated portion 20 flexing, and the impact end of the print wire 12 of that hammer will move up through the shuttle 8 and hit the paper or other recording medium, the precise point where that print wire will hit the paper being dependent upon the instantaneous position of the shuttle 8. When the electrical signal to the solenoid 18 terminates, the hammer 28 will fall back to its normal position as shown in FIG. 1, urged there by the resiliency of the flexed elongated portion 20.

In order to mount the stack of frame pieces 40 in the printer, the bottom support piece 34 is provided at one end with a retaining bracket 76 and is provided at its other end with a mounting screw 78 the tapered tip of which is adapted to wedgingly engage an appropriately inclined recess 80 formed in the left-hand side bar 48 of the frame piece 40, thereby to clamp the frame pieces 40 in place.

It would be possible, of course, where performance requirements are not too rigorous, to omit the magnets 56 and 58 from certain frames, thereby reducing the cost of the construction, provided that the magnets which are present produce for each solenoid magnetic fields of adequate strength. The frame pieces 40 without the magnets would still provide, with the frame pieces 40 adjacent thereto, requisite spaces within which the individual hammers 28 are received and movable.

It will be apparent that through the use of the modular construction here disclosed print heads embodying any desired number of hammers can be constructed from standardized uniform components, and that because the individual frame elements themselves carry the permanent magnets active on the solenoids the magnetic field within which each of the solenoids functions is maximized, thereby ensuring optimum performance. Because the frame pieces themselves are substantial structural elements which inherently produce the necessary spaces for receiving the hammers 28 and enabling them to move appropriately, the resultant construction is exceptionally sturdy and reliable.

While but a single embodiment of the present invention has been here specifically disclosed, it will be apparent that many variations may be made therein, all without departing from the spirit of the invention as defined in the following claims:

We claim:

1. A print head for use in a dot matrix printer comprising support members, a plurality of individual non-magnetic frames having opposite faces one of which carries a projecting part and having mounting holes through which said support members extend, said frames being stacked on said support members with one face of one adjacent frame engaging the projecting part of the other adjacent frame, each of said frames having an aperture therethrough between said opposite faces thereof within which a magnet is mounted so as to be exposed at said opposite faces, said magnets in said plurality of frames being similarly magnetically oriented when said frames are stacked on said support members, said projecting parts defining frame portions thicker than the depth of said apertures, thereby to produce spaces between the magnets of adjacent frames when said frames are stacked in engagement with adjacent frames, hammers comprising coils movably received in said spaces, said hammers further comprising print means movable with said coils and freely movably extending from said frames to points beyond said frames, and means for making electrical connection with said coils.

2. The print head of claim 1, in which said thicker portions extend over only part of the periphery of said frames, thereby to produce peripheral spaces between adjacent frames, said print means passing through said peripheral spaces.

3. The print head of claim 2, in which said means for making electrical connection with said coils extends out beyond said frames through said peripheral spaces.

4. The print head of claim 1, in which said frames have a plurality of apertures between said opposite faces thereof, said apertures being spaced from one another, each of said apertures having mounted therein a pair of said magnets which are oppositely magnetically oriented relative to each other and which are exposed at said opposite faces of said frame.

5. The print head of claim 4, in which said thicker portions extend over only part of the periphery of said frames, thereby to produce peripheral spaces between adjacent frames, said print means passing through said peripheral spaces.

6. The print head of claim 5, in which said means for making electrical connection with said coils extends out beyond said frames through said peripheral spaces.

* * * * *